United States Patent [19]

Weis et al.

[11] 4,319,624

[45] Mar. 16, 1982

[54] CLEANING MACHINE FOR CASTINGS

[75] Inventors: Martin Weis, Ettlingen; Hermann Dumbs, Gernsbach, both of Fed. Rep. of Germany

[73] Assignee: ARENCO-BMD Maschinenfabrik GmbH, Karlsruhe, Fed. Rep. of Germany

[21] Appl. No.: 174,746

[22] Filed: Aug. 4, 1980

[30] Foreign Application Priority Data

Aug. 3, 1979 [DE] Fed. Rep. of Germany ..... 2931578

[51] Int. Cl.[3] ..... B22D 29/00

[52] U.S. Cl. ..... 164/401; 164/269

[58] Field of Search ..... 164/401, 404, 344, 269, 164/131; 209/407, 406, 287, 288

[56] References Cited

U.S. PATENT DOCUMENTS 338,847 3/1886 Krom ..... 209/407

2,519,162 8/1950 Tucker ..... 209/399 X 3,795,311 3/1974 Martin ..... 209/403 X

*Primary Examiner*—Robert D. Baldwin

*Assistant Examiner*—K. Y. Lin

*Attorney, Agent, or Firm*—Craig and Antonelli

[57] ABSTRACT

A machine for the blast cleaning of castings has a drum with a top opening through which abrasive from overhead abrasive throwing wheels is directed onto castings in the drum. The drum is oscillated about its axis through an angle of about 120° and has two floor parts with an angle somewhat less than this between them. Oscillation of the drum makes for tumbling of the casting resting on the floor. The wall of the drum, in addition to the floor parts, has inwardly sloping parts next to the opening. The wall is made up of bars wedge-joined to support rings, sound being absorbed by rubber strips between them and the rings.

16 Claims, 6 Drawing Figures

CLEANING MACHINE FOR CASTINGS

BACKGROUND OF THE INVENTION (i) Field to which invention relates

The present invention relates to a cleaning machine for castings having a cleaning drum with a blast opening stretching in the length-direction thereof, a system for driving the cleaning drum oscillatingly about its long-axis with a center angle of about 120°, and with one or more abrasive throwing wheels placed over a blast opening, said drum being placed sloping from an inlet opening at one end thereof downwards to an opposite outlet opening.

(ii) The prior art

Unlike batch-operation cleaning machines, cleaning drums of the sort noted are responsible for the useful effect of continuous operation, the castings being run into the drum at one end and, on motion through the drum, at an adjustable speed if necessary, are blasted and are then continuously taken from the other end of the drum. To make it unnecessary for the abrasive throwing wheels to be moved with their supply pipes for the blasting abrasive, such wheels are stationarily positioned. The cleaning drum is moved, together with its peripheral blast opening, backwards and forwards under the abrasive throwing wheels. The center angle of this oscillating motion, and, for this reason, the breadth of the blast opening are generally dependent on the desired degree of filling of the drum and on the need for turning over the castings in the drum as completely as possible. In this respect a center angle of about 120° of oscillation has turned out to be of good effect. However, the need for complete turning over or tumbling of the castings is very much harder to take care of in the case of oscillating cleaning drums than in the case of batch operation drums, which are continuously kept turning.

In one earlier design (see the German Offenlegungsschrift specification No. 2,424,086) the cleaning drum has a part-cylindrical cross-section. At the edges of its opening, the drum wall is bent inwards at an angle for making possible the greatest possible center angle of oscillating motion without there being any danger of the castings' falling out past the edge of said opening. However, the number of different forms of castings which may be cleaned with the desired effect in such a drum is limited, because of slipping of the castings in the drum against the cylindrical drum walling without the desired tumbling or rolling over effect being produced. For this reason, for general works use, drums of this design have to have complex inner structures, in order to make certain that the castings are in fact turned and blasted on all sides. It is furthermore necessary for the drum's inner structures to have to be designed in line with the forms of the castings in question to make certain, on the one hand, of complete rolling or tumbling of the castings, while, on the other hand, not damaging less strong sorts of castings. All this makes a great number of tests necessary before a production run may be undertaken with the cleaning machine.

In addition to such prior art cleaning machines having a rigid cleaning drum, designs have been put forward in which the drum wall is in the form of an oscillating troughed transport belt or a continuously turning armored chain (see British Pat. No. 801,683 and Swiss Pat. No. 68,860). However, with respect to the turning over of the castings there are the same shortcomings in this respect as with cleaning drums having a stiff wall. In addition, there are shortcomings with respect to function, because such belts have to be made of wear-resistant material, that is to say belts with scales as armor. Furthermore, such designs are generally very high in price.

OUTLINE OF THE INVENTION

One purpose of the present invention is that of so designing a cleaning machine, of the sort noted at the start, and having an oscillatingly moved cleaning drum, that—without being dependent on the form of the workpieces and the degree of filling of the cleaning drum—complete turning over of the workpieces is made certain of at all times.

For effecting these and other purposes, in the present invention, the wall of the drum has a polygonal cross-section and has two floor parts, placed with an angle of about 120° between them and, next to them, wall parts between them and the blast opening.

Because of the opening angle of the two floor parts of 120° the greater part of the drum wall is formed by these floor parts. The angle of 120° makes certain that, in the case of an oscillation angle of roughly 120° as well, in the two end positions of the drum one or the other floor part is upright so that even those castings, which have been moved into the drum's end position without any motion in relation to the drum wall, will, at the latest, then be tipped over for falling downwards or tumbling. Field tests have made it clear that this outcome may be produced without the form or shape of the castings having any effect on operation.

In a preferred form of the invention the angle between the floor parts is somewhat less than 120°, for example between 110° and 116°, this making certain that, in the case of an oscillation angle of about 120°, one or the other of the floor parts will be sloping somewhat inwardly in the end position of the drum so that even castings, which are bulky and of great size, will be tipped over at the latest when the drum gets into this position.

The design of the drum in the present invention is not only responsible for the desired level of blasting of the castings, but furthermore makes blasting very much cheaper than, for example, blasting-cleaning using machines with a troughed or scale-armored transport belt.

The wall parts next to the two floor parts may be made up of two wall sections, whose angle to each other and with respect to the floor part is of such a size that the wall of the drum at the blast opening is designed running inwards somewhat, this stopping any falling out of castings from the drum, which are rolled over violently.

As part of a further development of the invention, at the join between the two floor parts, a girder is placed covering the join on the inside, this girder making certain that, on motion of the drum, a casting may not go freely slipping from one floor part to the other and, in fact, it comes up against a stop (in the form of the girder), which makes certain of the casting being turned over. In this respect, it is to be underlined that—unlike prior art designs—one such girder is all that is necessary.

The girder is preferably fixed by way of screws and locking (or counter) parts placed on the outside of the two floor parts, such a design offering specially useful effects if the separate wall sections are not joined together as a single-piece drum body and are separately fixed thereto. In this case, the two floor parts are forced, that is to say forcibly clamped, in relation to each other by the girder and the locking piece, while, at the same time, the space between them is sealed over.

Preferably the floor and wall parts are releasably fixed to a support structure of the drum. In this respect, the support structure may be made up of at least two support rings and longitudinal beams joining the same, the floor and wall parts being able to be undone from the support rings. The floor and wall parts, which generally undergo a different level of wear, may, for this reason, be replaced separately as needed.

Preferably, for this purpose, the floor and wall parts have webs or nosepieces at their outer sides, by way of which they may be fixed by wedges resting against webs and the support rings. This form of wedged join is specially in line with the needs of rough operation on the part of a foundry in which castings are cleaned, and makes possible simple assembly and replacement of the floor and wall parts.

In a development of the invention of good effect, the floor and wall parts have, at their outer faces, a web forming a nosepiece and the support rings have a web (parallel to the floor and wall parts) with side slots for taking up the axial ends of the webs of the floor parts, the last-named having, each one, a hole at their ends for the wedge which is placed behind the web of the support rings. If necessary, the wedge may be fixed in a position, but so as to be able to be undone, by a stop thereon. The wedge connection not only has the useful effects noted earlier with respect to assembly and changing parts, but furthermore that it may readily be undone even after being acted upon by blasting abrasive (which, in the case of other joins, makes for a welding effect).

Further developments of the invention are given in claims 11 to 15.

LIST OF FIGURES

A detailed account will now be given of the invention, to be seen, as one working example, in the figures.

DETAILED ACCOUNT OF WORKING EXAMPLE OF THE INVENTION

Figure 1:
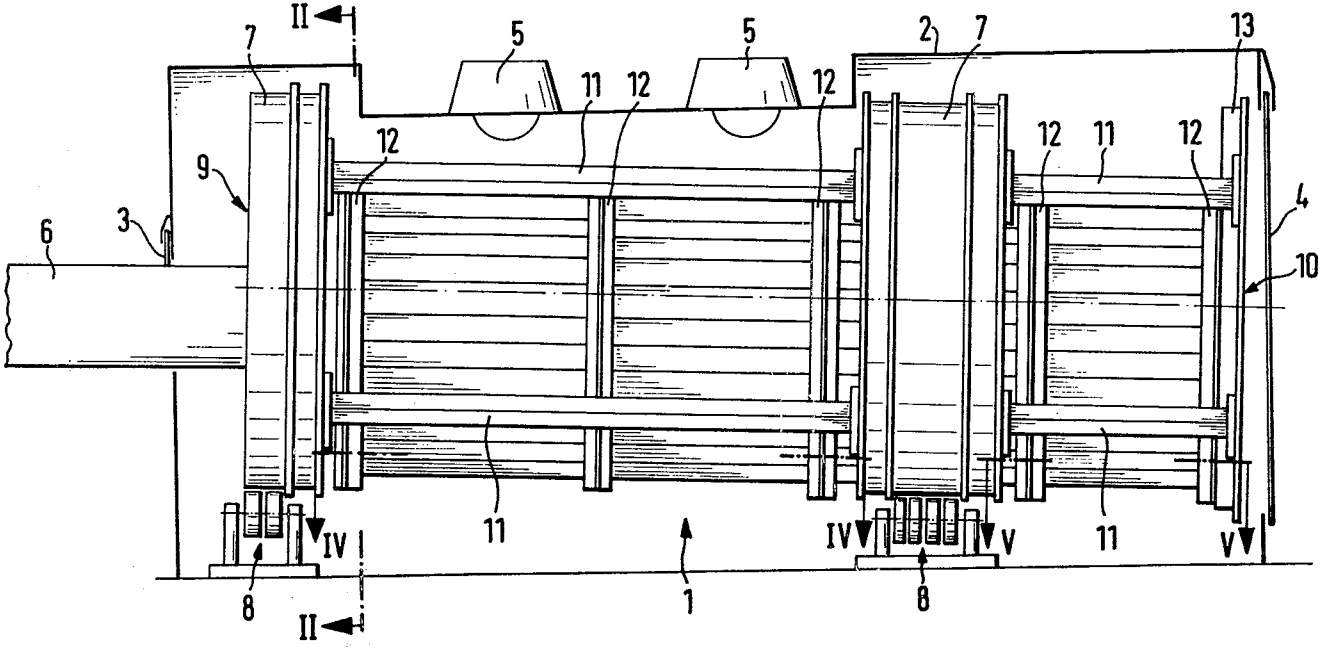
FIG. 1 is a diagrammatic side-view of the cleaning machine.

The cleaning machine to be seen diagrammatically in FIG. 1 is made up of a cleaning drum 1 within a dust-tight cleaning cabin 2, able to be shut at its ends by rubber curtains 3 and 4 or the like. At the top of the cleaning cabin 2, two or more abrasive throwing wheels 5 are stationarily positioned. The input of the castings may take place, for example, by way of a jog trough-like conveyer 6, while outlet of the castings takes place through the rubber curtain 4 by way of a slide, chute or the like.

The cleaning drum 1 has race rings 7, running on roller groups 8 and thereby supporting the drum. The driving system may be of a normal design. The axis of the cleaning drum 1 is at a slope running downwards from the inlet opening 9 to the outlet opening 10. However, in place of this, it will be possible for the race rings 7 to be upright and only for the drum wall to be placed at a slope. Furthermore, the cleaning drum 1 has a support structure made up of longitudinal beams 11, for example of box girder, that is to say pipe of square cross-section, and of a number of rings 12 placed side-by-side and fixed to beams 11. The longitudinal beams themselves are used for joining the race rings 7 together and, in the other case, with an end ring 13 or flange.

Figure 2:
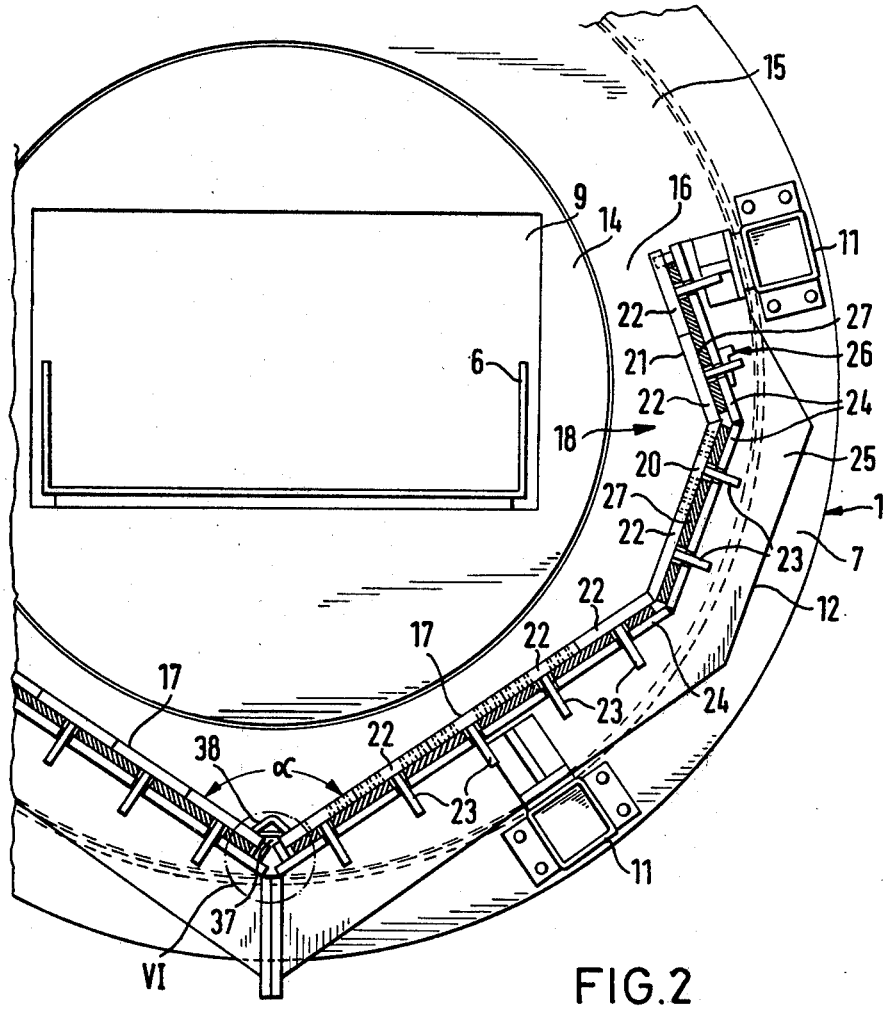
FIG. 2 is a section on the line II—II of FIG. 1.

As will be seen from FIG. 2, the inlet opening 9 is within and end plate 14 which is stationary, it only having a narrow space between it and the end member 15 of the cleaning drum 1. The wall of the cleaning drum 1 is cut away (under the abrasive throwing wheels 5 (FIG. 1)) by way of a sector for forming a blast opening 16. The sector is so designed that the drum, on being oscillated about its long-axis, may be turned through a center angle of about 120° without the blasting abrasive being directed against the edge of the blasting opening 16 or outside thereof.

The drum wall has two large-area floor parts 17, which, in the resting condition of the cleaning drum 1, come together at a lower apex at an angle of $\alpha$ between them of somewhat less than 120°, for example 112°. Next to the large-area floor parts 17, there is a wall part 18 made up of two wall sections 20 and 21, which are so designed and so positioned that there is a small inward slope of the drum wall at the blast opening 16, as will be seen from the placing of the wall section 21. The floor parts 17 and the wall parts 20, 21 are, in the working example of the invention presented, not made as a single-piece body, but are made up of separate parallel bars or slats 22 of the same size, their length being generally equal to the spacing between the rings 12 (FIG. 1). Each bar 22 has on its outer side a web 23, that is to say is in the form of a T-girder. On the same lines, the support rings 12 are in the form of T-girders, that is to say they have a wing or web 24, which is generally parallel to the bars 22, and an outwardly running wing 25 or web. The wings 24 of the support rings 12 are, in this respect, placed in a system with an outline answering to the system of the floor parts 17 and the wall parts 18. For making the drum wall stiffer by way of the support rings 12, their wings 25 may have an outline changing along the periphery of the drum in order, in this way, to make the area moment, responsible for taking up flexure forces, in line with the distance between the longitudinal beams 11. The bars 22, at least in the floor parts 17, are partly perforated to let through the blasting abrasive and materials cleaned from the casting. The webs 23 at the backs of the bars 22 have at their ends a wedge connection or joint 26, to be seen on the top right in FIG. 2, so that the bars are joined to, and may be undone from, the support rings 12. In this respect, between the wings 24 of the support rings 12 and the bars 22, sound-absorbing material strips, for example strips of rubber 27, are placed, used, furthermore, for stopping any vibrations, produced on operation, taking effect with their full force on the wedge joint 26.

Figure 3:
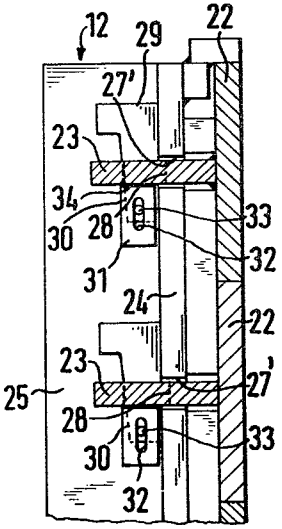
FIG. 3 is a partly sectioned, enlarged view of a wedge connection.

The wedge joint 26 is to be seen on a greater scale in FIG. 3. The wings 24 of the support rings 12 have side slots 27' taking up the ends of webs 23 fixed to bars 22. At these ends, webs 23 have holes 28, and—as seen from the inside of the drum—are placed, when assembled, to go through the webs 24 (that is to say on the other side of them) of the support rings 12. On the back side of the webs 24, a wedge 29 is hammered into the hole 28 in each case, the sloping face 30 of the wedge facing away from web 24. For locking the wedge 29, after hammering it into position, in place, a keeper plate 31 is used, having a slot 32 and fixed by way of a screw 33 (running through the stem of wedge 29) in such a way as to have its top edge 34 resting against the lower edge of web 23.

Figure 4:
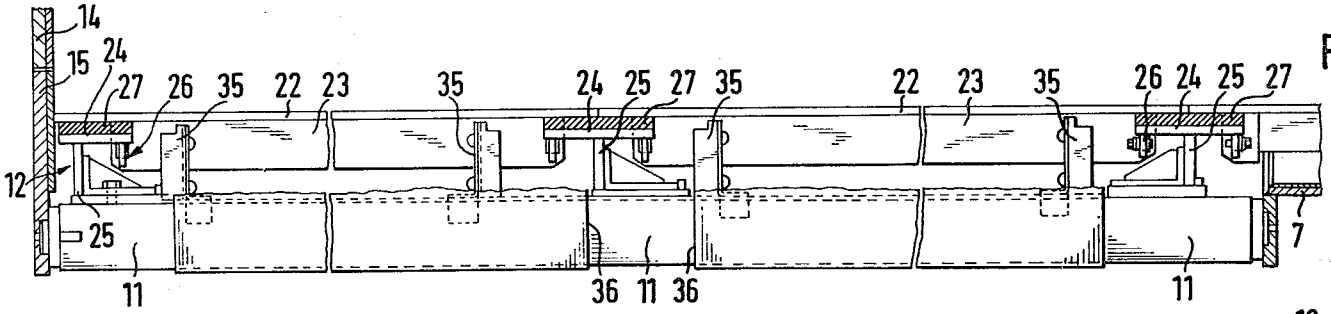
FIG. 4 is a section on the line IV—IV of FIG. 1.
Figure 5:
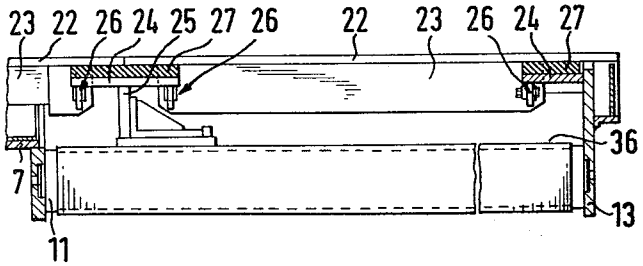
FIG. 5 is a section on the line V—V of FIG. 1.

As will be seen from the longitudinal section of FIG. 4 through the cleaning drum 1, in the blasting zone, that is to say under the abrasive throwing wheels 5 (FIG. 1), the blasting abrasive is let through the holes or perforations of bars 22, while still having a high energy level. For stopping overwear of the support structure, made up of the support rings 12 and the longitudinal beams 11, each support ring, on its sides turned towards the holes, has a wear shield 35, which is so positioned and designed that it may be readily changed over after undergoing wear. In the simplest case it is made up of sheet metal. Furthermore, over each longitudinal beam 11, a sheet metal lining element 36 (offering protection against wear) is slipped, it being present, more specially, between wear shield 35 covering the support rings 12. In the outlet part of the cleaning drum, to be seen in section in FIG. 5, in which, more importantly, any blasting abrasive and material cleaned from the castings is separated from the castings and let off to the outside, the support rings 12 do not have to be separately protected, because the blasting abrasive and material from the castings will only be falling out downwards under its own weight. For this reason, a sheet metal shield 36 is only present on the longitudinal beams.

Figure 6:
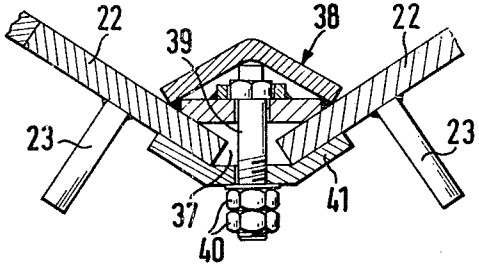
FIG. 6 is an enlarged section of the part within the circle VI of FIG. 2.

As will be seen from FIG. 6, over the lower joint 37, a girder 38 is placed which, as will be seen from the detailed view of FIG. 6, is used for covering the joint 37, the join 37 giving tolerance as necessary for exact assembly of the bars 22. The girder 38 is three-cornered in design, its two lower edges loosely resting against the lowermost bars 22. It is forced by a screwbolt 39 against bars 22 and between the screw nuts 40 and the lower face of the bars 22 locking (or counter) pieces 41 of the necessary form are placed.

We claim:

1. In a cleaning machine for castings with a cleaning drum having an inlet opening at one end, an outlet opening at an opposite end and a longitudinally extending blast opening, means for supporting said drum for rotation about a longitudinal axis with the drum sloping downwardly from the inlet opening to the outlet opening, a driving system for oscillating said drum about said longitudinal axis through an angle of 120°, and at least one abrasive throwing wheel mounted stationarily over said blast opening, the improvement comprising said drum having a wall structure of polygonal cross-section including two floor parts located opposite said blast opening which meet and form an angle of about 120° with respect to each other and a plurality of side wall parts defining said wall structure between said floor parts and said blast opening.

2. The cleaning machine as claimed in claim 1, wherein said angle between said floor parts is somewhat less than 120°.

3. The cleaning machine as claimed in claim 2, wherein said angle is in a range between 110° and 116°.

4. A cleaning machine according to claim 1, wherein the wall structure adjacent said blast opening is angled in an inwardly sloping manner decreasing the inner width of the drum in a direction toward said blast opening.

5. A cleaning machine according to claim 1, 2, 3, or 4, wherein a joint located between the two floor parts is covered at the inside of the drum by a girder.

6. A cleaning machine according to claim 5, wherein said girder is fixed against the two floor parts by locking pieces placed at opposite sides of the floor parts and connected together by screws passing through the joint.

7. A cleaning machine according to claim 1, 2, 3, or 4, wherein the floor parts and side wall parts are detachably mounted to a support structure of the drum.

8. A cleaning machine according to claim 7, wherein said support structure comprises at least two support rings and longitudinal girders connected thereto, said floor parts and side wall parts being detachably connected to said support rings.

9. A cleaning machine according to claim 7, wherein each of said floor and side wall parts is a T-girder having an outwardly extending web which extends through slots formed in said support rings to an outer side thereof and are detachably secured to said support rings by wedges which pass through slots in said webs at said outer side of the support rings.

10. A cleaning machine according to claim 9, further comprising a keeper plate detachably connected to each said wedge for removably securing it within a respective slot of the T-girder web.

11. A cleaning machine according to claim 9, wherein sound-absorbing material is positioned between the webs of the T-girders.

12. A cleaning machine according to claim 9, wherein the T-girders comprise parallel bars to which said webs are connected.

13. A cleaning machine according to claim 12, wherein all of said bars are the same size.

14. A cleaning machine according to claim 12, wherein at least part of those bars defining said bottom parts are perforated.

15. A cleaning machine according to claim 8, wherein at least part of said wall structure has perforations and wear shields for protection of the support rings and the longitudinal beams are mounted on sides thereof directed towards said perforations.

16. A cleaning machine according to claim 8, having webs on outer faces of the floor and wall parts and wedges joining the floor and wall parts to the support rings, acted upon by said wedges.

* * * * *